US009650703B2

(12) United States Patent
Lee et al.

(10) Patent No.: US 9,650,703 B2
(45) Date of Patent: May 16, 2017

(54) WEAR RESISTANT AUSTENITIC STEEL HAVING SUPERIOR MACHINABILITY AND TOUGHNESS IN WELD HEAT AFFECTED ZONES THEREOF AND METHOD FOR PRODUCING SAME

(71) Applicant: POSCO, Gyeongsangbuk-do (KR)

(72) Inventors: Soon-Gi Lee, Kyungsangbook-do (KR); Jong-Kyo Choi, Kyungsangbook-do (KR); Hee-Goon Noh, Kyungsangbook-do (KR); Hong-Ju Lee, Kyungsangbook-do (KR); In-Shik Suh, Kyungsangbook-do (KR); In-Gyu Park, Kyungsangbook-do (KR)

(73) Assignee: POSCO, Pohang-Si, Gyeongsangbuk-Do (KR)

( * ) Notice: Subject to any disclaimer, the term of this patent is extended or adjusted under 35 U.S.C. 154(b) by 520 days.

(21) Appl. No.: 14/368,604

(22) PCT Filed: Dec. 27, 2012

(86) PCT No.: PCT/KR2012/011535
§ 371 (c)(1),
(2) Date: Jun. 25, 2014

(87) PCT Pub. No.: WO2013/100612
PCT Pub. Date: Jul. 4, 2013

(65) Prior Publication Data

US 2014/0373588 A1 Dec. 25, 2014

(30) Foreign Application Priority Data

Dec. 28, 2011 (KR) ..... 10-2011-0145214
Dec. 21, 2012 (KR) ..... 10-2012-0151575

(51) Int. Cl.
*C22C 38/60* (2006.01)
*C22C 38/38* (2006.01)
(Continued)

(52) U.S. Cl.
CPC ..... *C22C 38/38* (2013.01); *B21B 1/026* (2013.01); *C21D 6/005* (2013.01); *C22C 38/00* (2013.01);
(Continued)

(58) Field of Classification Search
CPC ..... C22C 38/01; C22C 38/02; C22C 38/60; C22C 38/04; C22C 38/16; C22C 38/38; C22C 38/36; C22C 38/20
(Continued)

(56) References Cited

U.S. PATENT DOCUMENTS 3,193,384 A 7/1965 Richardson
4,975,335 A 12/1990 Wan
(Continued)

FOREIGN PATENT DOCUMENTS

CN 101248203 8/2008
EP 1 878 811 1/2008
(Continued)

OTHER PUBLICATIONS

First Office Action issued on Nov. 4, 2015, from the State Intellectual Property Office of the People's Republic of China in counterpart Chinese Patent Application 2012900706941.
(Continued)

*Primary Examiner* — David B Jones
(74) *Attorney, Agent, or Firm* — Finnegan, Henderson, Farabow, Garrett & Dunner, LLP

(57) ABSTRACT

There are provided a wear resistant austenitic steel having superior machinability and toughness in weld heat affected zones and a method for producing the austenitic steel. The
(Continued)

austenitic steel includes, by weight %, manganese (Mn): 15% to 25%, carbon (C): 0.8% to 1.8%, copper (Cu) satisfying 0.7C-0.56(%)≤Cu≤5%, and the balance of iron (Fe) and inevitable impurities, wherein the weld heat affected zones have a Charpy impact value of 100 J or greater at −40° C. The toughness of the austenitic steel is not decreased in weld heat affected zones because the formation of carbides during welding is suppressed, and the machinability of the austenitic steel is improved so that a cutting process may be easily performed on the austenitic steel. The corrosion resistance of the austenitic steel is improved so that the austenitic steel may be used for an extended period of time in corrosive environments.

8 Claims, 2 Drawing Sheets

(51) Int. Cl.

| | |
|---|---|
| ***C22C 38/02*** | (2006.01) |
| ***C22C 38/36*** | (2006.01) |
| ***C22C 38/04*** | (2006.01) |
| ***C21D 6/00*** | (2006.01) |
| ***C22C 38/00*** | (2006.01) |
| ***C22C 38/16*** | (2006.01) |
| ***C22C 38/20*** | (2006.01) |
| ***B21B 1/02*** | (2006.01) |
| *C21D 9/46* | (2006.01) |

(52) U.S. Cl.
CPC ..... *C22C 38/002* (2013.01); *C22C 38/02* (2013.01); *C22C 38/04* (2013.01); *C22C 38/16* (2013.01); *C22C 38/20* (2013.01); *C22C 38/36* (2013.01); *C22C 38/60* (2013.01); *C21D 9/46* (2013.01); *C21D 2211/001* (2013.01)

(58) Field of Classification Search
USPC ..... 420/9; 72/201
See application file for complete search history.

(56) References Cited

U.S. PATENT DOCUMENTS

| | | | | |
|---|---|---|---|---|
| 5,601,782 | A | 2/1997 | Kunioka et al. | |
| 2005/0178477 | A1 | 8/2005 | Igarashi et al. | |
| 2008/0035248 | A1 | 2/2008 | Cugy et al. | |
| 2008/0035249 | A1 | 2/2008 | Scott et al. | |
| 2008/0240969 | A1 | 10/2008 | Kim et al. | |
| 2009/0010793 | A1 | 1/2009 | Becker et al. | |
| 2009/0053556 | A1 | 2/2009 | Sohn et al. | |
| 2011/0308673 | A1 | 12/2011 | Schneider et al. | |
| 2012/0288396 | A1 | 11/2012 | Lee et al. | |
| 2014/0356220 | A1* | 12/2014 | Lee | C22C 38/002 420/9 |
| 2014/0373588 | A1* | 12/2014 | Lee | C22C 38/002 72/200 |
| 2015/0020928 | A1* | 1/2015 | Lee | C22C 38/001 148/529 |

FOREIGN PATENT DOCUMENTS

| | | |
|---|---|---|
| JP | 35-1503 | 3/1960 |
| JP | 54-081118 | 6/1979 |
| JP | 57-114643 | 7/1982 |
| JP | 01-172551 | 7/1989 |
| JP | 02-104633 | 4/1990 |
| JP | 11-061340 | 3/1999 |
| JP | 2003-055734 | 2/2003 |
| JP | 2008-519160 | 6/2008 |
| JP | 2008-520830 | 6/2008 |
| JP | 2009-506206 | 2/2009 |
| JP | 2009-521596 | 6/2009 |
| KR | 1994-0007374 B1 | 8/1994 |
| KR | 10-2006-0040718 | 5/2006 |
| KR | 10-2007-0023831 | 3/2007 |
| KR | 10-2007-0094801 | 9/2007 |
| KR | 10-2009-0043508 | 5/2009 |
| KR | 10-2011-0075610 | 7/2011 |
| SU | 954494 | 8/1982 |
| SU | 1325103 | 7/1987 |
| WO | WO 2004-083477 | 9/2004 |
| WO | WO 2007-024092 | 3/2007 |
| WO | WO 2011-081393 | 7/2011 |

OTHER PUBLICATIONS

English-language Extended European Search Report in counterpart European Patent Application EP 12862011, mailed Jan. 25, 2016.

Second Office Action from the State Intellectual Property Office (SIPO) People's Republic of China Application No. 201280070684.1, issued Jun. 20, 2016, 12 pages.

Notice of Office Action in counterpart Japanese Application No. 2014-550001, mailed on Jun. 30, 2015.

Korean Office Action dated Jun. 23, 2014 in related Korean patent application No. 10-2012-0151575, 4 pages.

International Search Report from the Korean Patent Office in International application No. PCT/KR2012/011535, Apr. 8, 2013, 4 pages.

* cited by examiner

WEAR RESISTANT AUSTENITIC STEEL HAVING SUPERIOR MACHINABILITY AND TOUGHNESS IN WELD HEAT AFFECTED ZONES THEREOF AND METHOD FOR PRODUCING SAME

TECHNICAL FIELD

The present disclosure relates to austenitic steel that may be used in various applications, and more particularly, to wear resistant austenitic steel having superior machinability and toughness in weld heat affected zones thereof, and a method for producing the wear resistant austenitic steel.

BACKGROUND ART

Austenitic steel is used in various applications owing to characteristics thereof such as work hardenability and nonmagnetic properties. Particularly, although ferritic or martensitic carbon steel having ferrite or martensite as a main microstructure thereof has been widely used, the characteristics of ferritic or martensitic carbon steels are limited, and thus the use of austenitic steel has increased as a substitute therefor, overcoming the disadvantages of ferritic and martensitic steels.

The use of austenitic steel has steadily increased in many industrial applications requiring steel having ductility and resistance to wear and hydrogen embrittlement, such as in rails for maglev rail systems; nonmagnetic structural members for general electrical devices and superconducting devices of nuclear fusion reactors; mining machinery in mines; general transportation; pipe expanding devices; slurry pipes; anti souring gas materials; and materials for mining, transportation, and storage in the oil and gas (petroleum) industries.

In the related art, austenitic stainless steel AISI304 (18Cr-8Ni) is a typical nonmagnetic steel material. However, such austenitic stainless steel is not suitable for structural members due to having low yield strength, and is not economical because large amounts of relatively expensive chromium (Cr) and nickel (Ni) are included. Particularly, since austenitic stainless steel is converted into a magnetic material if ferrite having ferromagnetic characteristics is formed therein by strain induced transformation, the austenitic stainless steel is not suitable for structural members requiring stable nonmagnetic characteristics not varying according to load. That is, the applications of austenitic stainless steel are limited.

Furthermore, along with the development, of the mining, oil, and gas industries, the wear on steel used for mining, transportation, and refining applications has become problematic. Particularly, although oil sands have been recently developed in earnest as an unconventional source of petroleum, the wear on steel members caused by slurry containing oil, gravel, and sand is one of the main factors increasing the production cost of oil from oil sands, and thus, the development and practical implementation of steel having a high degree of resistance to wear are increasingly required. In the mining industry, Hadfield steel having high wear resistance has commonly been used. Hadfield steel is austenitic steel in which the transformation of a microstructure to martensite having a high degree of hardness takes place in response to deformation.

The microstructure of such varied kinds of austenitic steel may be maintained as austenite by increasing the contents of manganese and carbon therein. In this case, however, carbides may be formed at high temperature along grain boundaries of austenite in the form of a network, thereby worsening characteristics of the austenitic steel, particularly, ductility of the austenitic steel. In addition thereto, larger amounts of carbides are formed in welded portions (weld heat affected zones) which are heated to high temperatures and subsequently cooled, and thus the toughness of the weld heat affected zones is markedly decreased.

A method of manufacturing high-manganese steel by rapidly cooling high-manganese steel to room temperature after a solution heat treatment or a hot working process, performed on high-manganese steel at a high temperature, has been proposed to prevent the formation of network-shaped carbide precipitates. However, if a thick steel sheet is formed by the proposed method, the effect of preventing the precipitation of carbides is not sufficiently obtained by rapid cooling. In addition, the precipitation of carbides may not be prevented in weld heat affected zones due to the effect of the heat history of the weld heat affected zones.

Furthermore, since the machinability of austenitic high-manganese steel is worsened due to a high degree of work hardenability, the lifespans of cutting tools may be decreased, and thus, costs for cutting tools may be increased. In addition, process suspension times may be increased due to the need for the frequent replacement of cutting tools. Thus, manufacturing costs may be increased.

DISCLOSURE

Technical Problem

An aspect of the present disclosure may provide austenitic steel having superior machinability and corrosion resistance and improved in terms of preventing a decrease in toughness in weld heat affected zones.

However, aspects of the present disclosure are not limited thereto. Additional aspects will be set forth in part in the description which follows, and will be apparent from the description to those having ordinary skill in the art to which the present disclosure pertains.

Technical Solution

According to an aspect of the present disclosure, wear resistant austenitic steel having superior machinability and toughness in weld heat affected zones thereof may include, by weight %, manganese (Mn): 15% to 25%, carbon (C) 0.8% to 1.8%, copper (Cu) satisfying $0.7C-0.56(\%) \leq Cu \leq 5\%$, and the balance of iron (Fe) and inevitable impurities, wherein the weld heat affected zones may have a Charpy impact value of 100 J or greater at −40° C.

According to another aspect of the present disclosure, a method of producing wear resistant austenitic steel having superior machinability and toughness in weld heat affected zones thereof may include: reheating a steel slab to a temperature of 1050° C. to 1250° C., the steel slab including, by weight %, manganese (Mn): 15% to 25%, carbon (C) 0.8% to 1.8%, copper (Cu) satisfying $0.7C-0.56(\%) \leq Cu \leq 5\%$ where C denotes a content of the carbon (C) by weight %, and the balance of iron (Fe) and inevitable impurities; and performing a finish rolling process on the reheated steel slab within a temperature range of 800° C. to 1050° C.

Advantageous Effects

According to the present disclosure, the toughness of the austenitic steel is not decreased in weld heat affected zones thereof because the formation of carbides during welding is suppressed, and the machinability of the austenitic steel is improved so that a cutting process may be easily performed on the austenitic steel. In addition, the corrosion resistance of the austenitic steel is improved so that the austenitic steel may be used for an extended period of time in corrosive environments.

BEST MODE

Hereafter, wear resistant austenitic steel having superior machinability and toughness in weld heat affected zones thereof will be described in detail according to embodiments of the present disclosure, so that those of ordinary skill in the related art may clearly understand the scope and spirit of the embodiments of the present disclosure.

The inventors found that if the composition of steel is properly adjusted, although large amounts of manganese and carbon are added to the steel to maintain the microstructure of the steel in an austenitic structure, the machinability of the steel is improved without causing a carbide-induced decrease in toughness in weld heat affected zones. Based on this knowledge, the inventors invented wear resistant austenitic steel and a method of producing the wear resistant austenitic steel.

That is, manganese and carbon are added to the steel of the embodiments of the present disclosure to obtain an austenitic microstructure in the steel while controlling the content of the carbon relative to the content of the manganese to minimize the formation of carbides during a heating cycle such as welding of the steel. Furthermore, additional elements are added to the steel to further suppress the formation of carbides and this to ensure sufficient toughness in weld heat affected zones, and in conjunction therewith, the contents of calcium and sulfur are adjusted to markedly improve the machinability of the steel (austenitic high-manganese steel).

According to the embodiments of the present disclosure, the steel may include, by weight %, manganese (Mn): 15% to 25%, carbon (C): 0.8% to 1.8%, copper (Cu) satisfying $0.7C-0.56(\%) \leq Cu \leq 5\%$, and the balance of iron (Fe) and inevitable impurities.

The numerical ranges of the contents of the elements are set for the reasons described below. In the following description, the content of each element is given in weight % unless otherwise specified.

Manganese (Mn): 15% to 25%

Figure 1:
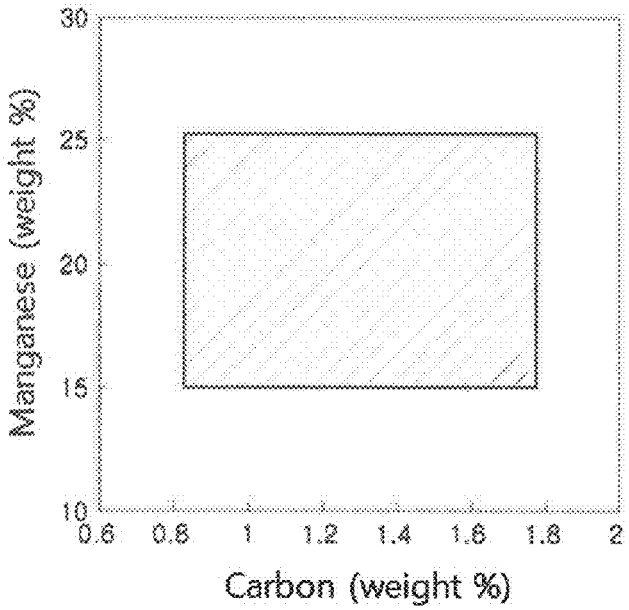
FIG. 1 is a graph illustrating a relationship between the contents of manganese and carbon according to an embodiment of the present disclosure.

Manganese is a main element for stabilizing austenite in high manganese steel like the steel of the embodiments of the present disclosure. In the embodiments of the present disclosure, it may be preferable that manganese be added to the steel in an amount of 15% or more as shown in FIG. 1 so as to form austenite as a main microstructure. If the content of manganese is less than 15%, the stability of austenite may be decreased, and thus sufficient low-temperature toughness may not be obtained. However, if the content of manganese is greater than 25%, problems such as decrease in a corrosion resistance of the steel, increase in difficulties in the manufacturing process and increase in manufacturing costs may occur. Also, the work hardenability of the steel may be decreased due to a decreased in tensile strength.

Carbon (C) 0.8% to 1.8%

Carbon is an element for stabilizing austenite and forming austenite at room temperature. Carbon increases the strength of the steel. Particularly, carbon dissolved in austenite of the steel increases the work hardenability of the steel and thus increases the wear resistance of the steel. In addition, carbon is an important element for giving austenite-induced non-magnetic characteristics to the steel.

To this end, it may be preferable that the content of carbon be 0.8 weight % or greater as shown in FIG. 1. If the content of carbon is too low, austenite may not be stabilized, and wear resistance may be decreased due to a lack of dissolved carbon. On the other hand, if the content of carbon is excessive, it may be difficult to suppress the formation of carbides, particularly in weld heat affected zones. Therefore, in the embodiments of the present disclosure, it may be preferable that the content of carbon be within the range of 0.8 weight % to 1.8 weight %. More preferably, the content of carbon may be within the range of 1.0 weight % to 1.8 weight %.

Copper (Cu): $0.7C-0.56(\%) \leq Cu \leq 5\%$

Due to a low solid solubility of copper in carbides and a low diffusion rate of copper in austenite, copper tends to concentrate in interfaces between austenite and carbides. Therefore, if fine carbide nuclei are formed, copper may surround the fine carbide nuclei, and thus additional diffusion of carbon and growth of carbides may be retarded. That is, copper suppresses the formation and growth of carbides. Therefore, in the embodiments of the present disclosure, copper is added to the steel. The amount of copper in the steel may not be independently determined but may be determined according to the formation behavior of carbides, particularly, the formation behavior of carbides in weld heat affected zones during a welding process. For example, the content of copper may be set to be equal to or greater than 0.7C-0.56 weight % so as to effectively suppress the formation of carbides. If the content of copper in the steel is less than 0.7C-0.56 weight %, the conversion of carbon into carbides may not be suppressed. In addition, if the content of copper in the steel is greater than 5 weight %, the hot workability of the steel may be lowered. Therefore, it may be preferable that the upper limit of the content of copper be set to be 5 weight %. Particularly, in the embodiments of the present disclosure, when the content of carbon added to the steel for improving wear resistance is considered, the content of copper may preferably be 0.3 weight % or greater, more preferably, 2 weight % or greater, so as to obtain a sufficient effect of suppressing the formation of carbides.

In the embodiments of the present disclosure, the other component of the steel is iron (Fe). However, impurities of raw materials or manufacturing environments may be inevitably included in the steel, and such impurities may not be removed from the steel. Such impurities are well-known to those of ordinary skill in manufacturing industries, and thus descriptions thereof will not be given in the present disclosure.

In the embodiments of the present disclosure, sulfur (S) and calcium (Ca) may be further included in the steel in addition to the above-described elements, so as to improve the machinability of the steel.

Sulfur (S): 0.03% to 0.1%

In general, it is known that sulfur added together with manganese forms manganese sulfide which is easily cut and separated during a cutting process. That is, sulfur is known as an element improving the machinability of steel. In addition, sulfur is melted by heat generated during a cutting process, and thus reduces friction between chips and cutting tools during cutting processes. That is, sulfur increases the lifespan of cutting tools by lubricating the surfaces of cutting tools, reducing the wear of the cutting tool, and preventing accumulation of cutting chips on the cutting tool. However, if the content of sulfur in the steel is excessive, mechanical characteristics of the steel may deteriorate due to a large amount of coarse manganese sulfide elongated during a hot working process, and the hot workability of the steel may deteriorate due to the formation of iron sulfide. Therefore, it may be preferable that the upper limit of the content of sulfur in the steel be 0.1%. If the content of sulfur in the steel is less than 0.03%, the machinability of the steel may not be improved, and thus it may be preferable that the lower limit of the content of sulfur in the steel be 0.03%.

Calcium (Ca): 0.001% to 0.01%

Calcium is usually used to control the formation of manganese sulfide. Since calcium has a high affinity for sulfur, calcium forms calcium sulfide together with sulfur, and along therewith, calcium is dissolved in manganese sulfide. Since manganese sulfide crystallizes around calcium sulfide functioning as crystallization nuclei, manganese sulfide may be less elongated and may be maintained in a spherical shape during a hot working process. Therefore, the machinability of the steel may be improved. However, if the content of calcium is greater than 0.01%, the above-described effect is saturated. In addition, since the percentage recovery of calcium is low, a large amount of calcium raw material may have to be used, and thus the manufacturing cost of the steel may be increased. On the other hand, if the content of calcium in the steel is less than 0.001%, the above-described effect is insignificant. Thus, it may be preferable that the lower limit of the content of calcium be 0.001%.

The steel of the embodiments of the present disclosure may further include chromium (Cr) in addition to the above-described elements.

Cr: 8% or Less (Excluding 0%)

Generally, manganese lowers the corrosion resistance of steel. That is, in the embodiments of the present disclosure, manganese included in the steel within the above-described content range may lower the corrosion resistance of the steel, and thus chromium is added to the steel to improve the corrosion resistance of the steel. In addition, if chromium is added to the steel in an amount within the range, the strength of the steel may also be improved. However, if the content of chromium in the steel is greater than 8 weight %, the manufacturing cost of the steel is increased, and carbon dissolved in the steel may be converted into carbides along grain boundaries to lower the ductility of the steel and particularly the resistance of the steel to sulfide stress cracking. In addition, ferrite may be formed in the steel, and thus austenite may not be formed as a main microstructure in the steel. Therefore, it may be preferable that the upper limit of the content of chromium be 8 weight %. Particularly, to maximize the effect of improving the corrosion resistance of the steel, it may be preferable that the content of chromium in the steel be set to be 2 weight % or greater. Since the corrosion resistance of the steel is improved by the addition of chromium, the steel may be used for forming slurry pipes or as an anti sour gas material. Furthermore, the yield strength of the steel may be stably maintained at 450 MPa or greater by the addition of chromium.

The steel having the above-described composition has an austenitic microstructure and a high degree of toughness in weld heat affected zones thereof. The steel of the embodiments of the present disclosure may have a Charpy impact value of 100 J at −40° C. in a weld heat affected zone.

In the embodiments of the present disclosure, the steel having the above-described composition is austenitic steel the microstructure of which has 95 volume % or more of austenite in weld heat affected zones. The steel of the embodiments of the present disclosure may be used as a material for forming other products. In addition, the steel of the embodiment of the present disclosure may be a part welded to a final product. As described above, austenite formed in the steel may have various functions. In addition to austenite, some other microstructures such as martensite, bainite, pearlite, and ferrite may be inevitably formed in the steel as impurity microstructures. In the present disclosure, the sum of the amounts of the phases of the steel is put as 100%, and the content of each microstructure is denoted as a proportion of the sum without considering the amounts of precipitates such as a carbide precipitate.

Furthermore, in the embodiments of the present disclosure, it may be preferable that the microstructure of weld heat affected zones of the steel include 5 volume % or less of carbides (based on the total volume of the microstructure). In this case, a decrease in toughness of the weld heat affected zones caused by carbides may be minimized.

In the embodiments of the present disclosure, the steel satisfying the above-described conditions may be produced by a manufacturing method known in the related art, and a detailed description thereof will not be given. The manufacturing method of the related art may include a conventional hot rolling process in which a slab is reheated, roughly-rolled, and finish-rolled. For example, according to an embodiment of the present disclosure, the steel may be produced as follows.

Reheating Temperature: 1050° C. to 1250° C.

A steel slab or ingot is reheated in a reheating furnace for a hot rolling process. If the steel slab or ingot is reheated to a temperature lower than 1050° C., the load acting on a rolling mill may be markedly increased, and alloying elements may not be sufficiently dissolved in the steel slab or ingot. On the other hand, if the reheating temperature of the steel slab or ingot is too high, crystal grains may grow excessively, and thus, the strength of the steel slab or ingot may be lowered. Particularly, in the above-described composition range of the steel of the embodiments of the present disclosure, carbides may melt in grain boundaries, and if the steel slab or ingot is reheated to a temperature equal to or higher than the solidus line of the steel slab or ingot, hot-rolling characteristics of the steel slab or ingot may deteriorate. Therefore, the upper limit of the reheating temperature may be set to be 1250° C.

Finish Rolling Temperature: 800° C. To 1050° C.

The steel (slab or ingot) having the above-described composition is hot-rolled within the temperature range of 800° C. to 1050° C. If the hot rolling is performed at a temperature lower than 800° C., the rolling load may be large, and carbides may precipitate and grow coarsely. The upper limit of the hot rolling temperature may be set to be 1050° C. which is the lower limit of the reheating temperature.

After the hot rolling, the steel may be cooled by a conventional cooling method. In this case, the cooling rate is not limited to a particular value.

MODE FOR INVENTION

Hereinafter, the embodiments of the present disclosure will be described more specifically through examples. However, the examples are for clearly explaining the embodiments of the present disclosure and are not intended to limit the spirit and scope of the present disclosure.

EXAMPLE 1

Slabs having elements and compositions shown in Table 1 below were reheated at 1150° C. Thereafter, the slabs were finish-rolled at about 900° C. and cooled to form hot-rolled steel sheets. The yield strength, microstructure, carbide fraction of each steel sheet were measured as shown in Table 2 below. In addition, the steel sheets were welded by a butt welding method. Then, the volume fraction of carbides in a weld heat affected zone (HAZ) of each steel sheet was measured, and the Charpy impact value of the weld heat affected zone was measured at −40° C. The measured values are shown in Table 2 below. Although not shown in Table 2, the volume fraction of carbides in the weld heat affected zone of each inventive sample was 5% or less as intended in the embodiments of the present disclosure. In Table 1, the content of each element is given in weight %.

TABLE 1

| No. | C | Mn | Cu | Cr | 0.7 C.-0.56 |
|---|---|---|---|---|---|
| Comparative sample A1 | 1.5 | 14 | | | 0.5 |
| Comparative sample A2 | 1.2 | 13 | | | 0.3 |
| Comparative sample A3 | 0.9 | 10 | | | 0.1 |
| Comparative sample A4 | 1.6 | 22 | | | 0.6 |
| Comparative sample A5 | 1.4 | 16 | 0.2 | | 0.4 |
| Comparative sample A6 | 0.95 | 20 | 5.3 | | 0.1 |
| Inventive sample A1 | 1.2 | 17.5 | 0.85 | | 0.3 |
| Inventive sample A2 | 0.9 | 20 | 0.5 | | 0.1 |
| Inventive sample A3 | 1.5 | 23 | 1.23 | | 0.5 |
| Inventive sample A4 | 1.12 | 16 | 0.76 | | 0.2 |
| Inventive sample A5 | 1.25 | 18.6 | 1.1 | 2 | 0.3 |
| Inventive sample A6 | 0.9 | 18 | 0.3 | 3 | 0.1 |

TABLE 2

| No. | Yield strength of steel sheet (MPa) | Carbide fraction in HAZ (Volume %) | Charpy impact value at HAZ (J, −40° C.) |
|---|---|---|---|
| Comparative sample A1 | 412 | 15 | 36 |
| Comparative sample A2 | 379 | 12 | 37 |
| Comparative sample A3 | 303 | 0 | 40 |
| Comparative sample A4 | 425 | 8.1 | 42 |
| Comparative sample A5 | 417 | 7.6 | 45 |
| Comparative sample A6 | Impossible to measure | Impossible to measure | Impossible to measure |
| Inventive sample A1 | 379 | 2.1 | 163 |
| Inventive sample A2 | 322 | 0 | 173 |
| Inventive sample A3 | 436 | 1.3 | 282 |

TABLE 2-continued

| No. | Yield strength of steel sheet (MPa) | Carbide fraction in HAZ (Volume %) | Charpy impact value at HAZ (J, −40° C.) |
|---|---|---|---|
| Inventive sample A4 | 364 | 2.5 | 130 |
| Inventive sample A5 | 476 | 0.8 | 207 |
| Inventive sample A6 | 521 | 0 | 165 |

In addition, the corrosion rate of each of comparative samples and inventive samples was measured by an immersion test, and the results are shown in Table 3 below.

TABLE 3

| | Corrosion rate (mm/year) | |
|---|---|---|
| No. | 3.5% NaCl, 50° C., 2 weeks | 0.05M $H_2SO_4$, 2 weeks |
| Comparative sample A1 | 0.14 | 0.47 |
| Comparative sample A2 | 0.15 | 0.47 |
| Comparative sample A3 | 0.14 | 0.46 |
| Comparative sample A4 | 0.16 | 0.50 |
| Comparative sample A5 | 0.14 | 0.46 |
| Comparative sample A6 | Impossible to measure | Impossible to measure |
| Inventive sample A1 | 0.14 | 0.48 |
| Inventive sample A2 | 0.17 | 0.49 |
| Inventive sample A3 | 0.18 | 0.50 |
| Inventive sample A4 | 0.17 | 0.47 |
| Inventive sample A5 | 0.09 | 0.41 |
| Inventive sample A6 | 0.07 | 0.37 |

The manganese contents of Comparative Samples A1 and A2 were outside of the range of the embodiments of the present disclosure, and the carbon contents of Comparative Samples A1 and A2 were high. Thus, carbides precipitated in the form of a network in weld heat affected zones of Comparative Samples A1 and A2, and the carbide factions in the weld heat affected zones of the Comparative Samples A1 and A2 were 5% or greater. As a result, Comparative Samples A1 and A2 had very low toughness values in the weld heat affected zones thereof.

In addition, although carbides did not precipitate in Comparative Sample A3 having a low carbon content, the manganese content of Comparative Sample A3 was outside of the range of the embodiments of the present disclosure. Therefore, austenite stability was low, and thus transformation from austenite into martensite was easily induced at a low temperature. As a result, Comparative Sample A3 had a very low toughness value.

The carbon content of Comparative Sample A4 was greater than the range of the embodiments of the present disclosure, and thus the fraction of precipitated carbides in Comparative Sample A4 was 5% or greater. Thus, the toughness of Comparative Sample A4 deteriorated at low temperature.

The carbon content and manganese content of Comparative Sample A5 were within the ranges of the embodiments of the present disclosure. However, the copper content of Comparative Sample A5 was outside of the range of the embodiments of the present disclosure. Therefore, precipitation of carbides was not effectively suppressed, and thus the toughness of Comparative. Sample A5 was low at low temperature.

The manganese content and carbon content of Comparative Sample A6 were within the ranges of the embodiments of the present disclosure. However, the copper content of Comparative Sample A6 was greater than the range of the embodiments of the present disclosure. Therefore, hot working characteristics of Comparative Sample A6 deteriorated markedly, and Comparative Sample A6 was markedly cracked during a hot working process. That is, Comparative Sample A6 was not suitable for a hot rolling process, and it was impossible to measure properties of Comparative Sample A6.

However, in Inventive Samples A1 to A6 having elements and compositions according to the embodiments of the present disclosure, the precipitation of carbides in grain boundaries of weld heat affected zones was effectively suppressed owing to the addition of copper, and the volume fraction of carbides was adjusted to be 5% or less. Thus, Inventive Samples A1 to A6 had high toughness at low temperature. In detail, although Inventive Samples A1 to A6 had high carbon contents, the formation of carbides was effectively suppressed owing to the addition of copper, and thus Inventive Samples A1 and A6 had desired microstructures and properties.

Particularly, according to the results of a corrosion test, the corrosion rates of Inventive Samples A5 and A6 to which chromium was additionally added were low. That is, the corrosion resistance of Inventive Samples A5 and A6 was improved. This effect of improving corrosion resistance by the addition of chromium may be clearly understood by comparison with corrosion rates of Inventive Samples A1 to A4. In addition, the strength of Inventive Samples A5 and A6 was improved by solid-solution strengthening induced by the addition of chromium.

Figure 2:
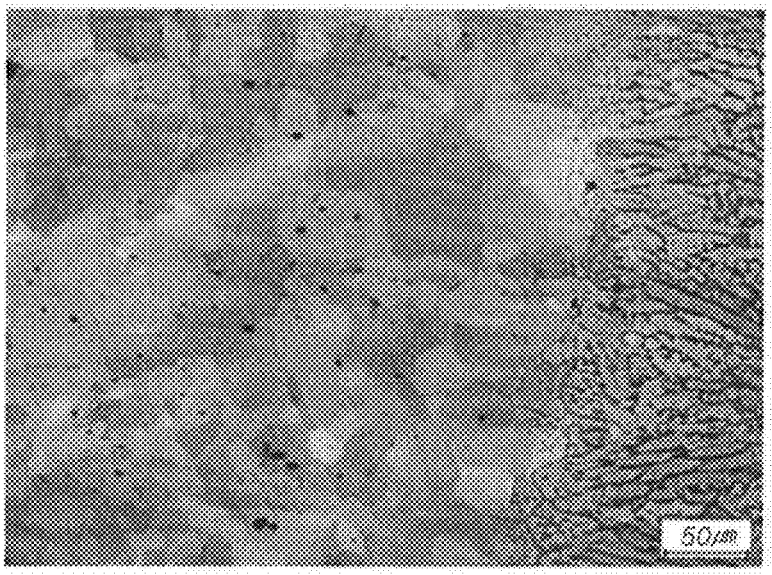
FIG. 2 is a microstructure image of a weld heat affected zone in an example of the present disclosure.

FIG. 2 is a microstructure image of a weld heat affected zone of Inventive Sample A2. Referring to FIG. 2, although Inventive Sample A2 has a high carbon content, carbides are not present in Inventive Sample A2 owing to the addition of copper within the range of the embodiments of the present disclosure.

EXAMPLE 2

Slabs having elements and compositions shown in Table 4 below were reheated at 1150° C. Thereafter, the slabs were finish-rolled at about 900° C. and cooled to form hot-rolled steel sheets. In Table 4, the content of each element is given in weight %.

TABLE 4

| No. | C | Mn | Cu | Cr | 0.7C-0.56 | Ca | S |
|---|---|---|---|---|---|---|---|
| Comparative sample B1 | 1.2 | 17.5 | 0.85 | | 0.3 | | |
| Comparative sample B2 | 0.9 | 20 | 0.5 | | 0.1 | | 0.01 |
| Comparative sample B3 | 1.5 | 23 | 1.23 | | 0.5 | | |
| Comparative sample B4 | 1.12 | 16 | 0.76 | | 0.2 | | 0.02 |
| Comparative sample B5 | 1.25 | 18.6 | 1.1 | 2 | 0.3 | | |
| Inventive sample B1 | 1.19 | 17.5 | 0.87 | | 0.3 | 0.005 | 0.05 |
| Inventive sample B2 | 0.92 | 21 | 0.45 | | 0.1 | 0.006 | 0.03 |
| Inventive sample B3 | 0.9 | 21.5 | 0.47 | | 0.1 | 0.006 | 0.05 |
| Inventive sample B4 | 0.88 | 20.6 | 0.47 | | 0.1 | 0.007 | 0.08 |
| Inventive sample B5 | 1.48 | 22.5 | 1.19 | | 0.5 | 0.005 | 0.05 |
| Inventive sample B6 | 1.15 | 17.3 | 0.59 | | 0.2 | 0.008 | 0.06 |
| Inventive sample B7 | 1.18 | 18 | 1.2 | 2 | 0.3 | 0.004 | 0.08 |

In addition, the steel sheets were welded by a butt welding method. Then, the yield strength of each steel sheet and the volume fraction of carbides in a weld heat affected zone (HAZ) of each steel sheet were measured, and the Charpy impact value of the weld heat affected zone (HAZ) of each steel sheet was measured at −40° C. The measured values are shown in Table 5 below. Holes were repeatedly formed in each of the steel sheets by using a drill having a diameter of 10 mm and formed of high speed tool steel in conditions of a drill speed of 130 rpm and a drill movement rate of 0.08 mm/rev. The number of holes formed in each steel sheet until the drill was worn down to the end of its effective lifespan was counted as shown in Table 5.

TABLE 5

| No. | Yield strength of steel sheet (MPa) | Carbide fraction in HAZ (volume %) | Charpy impact value at HAZ (J, −40° C.) | Number of holes |
|---|---|---|---|---|
| Comparative sample B1 | 379 | 2.1 | 163 | 0 |
| Comparative sample B2 | 322 | 0 | 173 | 2 |
| Comparative sample B3 | 436 | 1.3 | 282 | 0 |
| Comparative sample B4 | 364 | 2.5 | 130 | 0 |
| Comparative sample B5 | 476 | 0.8 | 207 | 1 |
| Inventive sample B1 | 377 | 2.0 | 161 | 3 |
| Inventive sample B2 | 325 | 0 | 191 | 6 |
| Inventive sample B3 | 322 | 0 | 197 | 9 |
| Inventive sample B4 | 318 | 0 | 181 | 12 |
| Inventive sample B5 | 432 | 1.3 | 272 | 2 |
| Inventive sample B6 | 369 | 2.7 | 154 | 3 |
| Inventive sample B7 | 469 | 0.7 | 189 | 5 |

In addition, the corrosion rate of each of comparative samples and inventive samples was measured by an immersion test according to ASTM G31, and the results are shown in Table 6 below.

TABLE 6

| No. | Corrosion rate (mm/year) 3.5% NaCl, 50° C., 2 weeks | 0.05M $H_2SO_4$, 2 weeks |
|---|---|---|
| Comparative sample B1 | 0.14 | 0.48 |
| Comparative sample B2 | 0.17 | 0.49 |
| Comparative sample B3 | 0.18 | 0.50 |
| Comparative sample B4 | 0.17 | 0.47 |
| Comparative sample B5 | 0.09 | 0.41 |
| Inventive sample B1 | 0.14 | 0.47 |
| Inventive sample B2 | 0.17 | 0.48 |
| Inventive sample B3 | 0.16 | 0.48 |
| Inventive sample B4 | 0.17 | 0.47 |
| Inventive sample B5 | 0.18 | 0.51 |
| Inventive sample B6 | 0.18 | 0.48 |
| Inventive sample B7 | 0.08 | 0.42 |

In the inventive samples having elements and compositions according to the embodiments of the present disclosure, precipitation of carbides in grain boundaries of weld heat affected zones was effectively suppressed owing to the addition of copper, and the volume fraction of carbides was adjusted to be 5% or less. Thus, the inventive samples had high toughness at low temperature. In detail, although the inventive samples had high carbon contents, the formation of carbides was effectively suppressed owing to the addition of copper, and thus the inventive samples had desired microstructures and properties.

Particularly, according to results of a corrosion test, the corrosion rates of Comparative Samples B5 and Inventive Sample B7 to which chromium was additionally added were low. That is, the corrosion resistance of Comparative Sample B5 and Inventive Sample B7 was improved. In addition, the yield strength of Comparative Sample B5 and Inventive Sample B7 was improved to be 450 MPa or greater by solid-solution strengthening induced by the addition of chromium.

The machinability of Comparative Samples B1 to B5 was poor because sulfur and calcium were not added to Comparative Samples B1 to B5 or the contents of sulfur and calcium in Comparative Samples B1 to B5 were outside of the ranges of the embodiments of the present disclosure.

However, Inventive Samples B1 to B7 including sulfur and calcium within the content ranges of the embodiments of the present disclosure had superior machinability as compared with the comparative samples. Particularly, in Inventive Samples B2 to B4 having different sulfur contents, the machinability thereof was improved in proportion to the content of sulfur.

Figure 3:
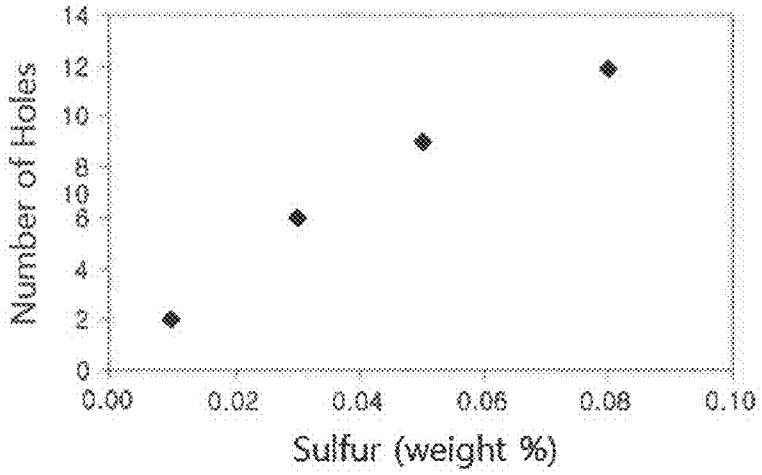
FIG. 3 is a graph illustrating a relationship between the content of sulfur and machinability in an example of the present disclosure.

FIG. 3 illustrates machinability with respect to the content of sulfur. Referring to FIG. 3, machinability improves in proportion to the content of sulfur.

The invention claimed is:

1. Wear resistant austenitic steel having superior machinability and toughness in weld heat affected zones thereof, the wear resistant austenitic steel comprising, by weight %, manganese (Mn): 15% to 25%, carbon (C): 0.8% to 1.8%, copper (Cu) satisfying $0.7C-0.56(\%) \leq Cu \leq 5\%$, and the balance of iron (Fe) and inevitable impurities, wherein the weld heat affected zones have a Charpy impact value of 100 J or greater at −40° C.

2. The wear resistant austenitic steel of claim 1, further comprising, by weight %, sulfur (S): 0.03% to 0.1%, and calcium (Ca): 0.001% to 0.01%.

3. The wear resistant austenitic steel of claim 1, further comprising, by weight %, chromium (Cr): 8% or less (excluding 0%), wherein the wear resistant austenitic steel has a yield strength of 450 MPa or greater.

4. The wear resistant austenitic steel of claim 1, wherein the weld heat affected zones have a microstructure comprising 95 volume % or more of austenite.

5. The wear resistant austenitic steel of claim 1, wherein the weld heat affected zones have a microstructure comprising 5 volume % or less of carbides.

6. A method of producing wear resistant austenitic steel having superior machinability and toughness in weld heat affected zones thereof, the method comprising:

reheating a steel slab to a temperature of 1050° C. to 1250° C., the steel slab comprising, by weight %, manganese (Mn): 15% to 25%, carbon (C): 0.8% to 1.8%, copper (Cu) satisfying $0.7C-0.56(\%) \leq Cu \leq 5\%$ where C denotes a content of the carbon (C) by weight %, and the balance of iron (Fe) and inevitable impurities; and performing a finish rolling process on the reheated steel slab within a temperature range of 800° C. to 1050° C.

7. The method of claim 6, wherein the steel slab further comprises, by weight %, sulfur (S): 0.03% to 0.1%, and calcium (Ca): 0.001% to 0.01%.

8. The method of claim 6, wherein the steel slab further comprises, by weight %, chromium (Cr): 8% or less (excluding 0%), and the steel slab has a yield strength of 450 MPa or greater.

* * * * *